US007836660B2

(12) United States Patent
Gharibeh et al.

(10) Patent No.: US 7,836,660 B2
(45) Date of Patent: Nov. 23, 2010

(54) METHOD OF MAKING A COMPOSITE BUILDING PANEL

(75) Inventors: Rene A. Gharibeh, Waukesha, WI (US); Marcelle R. Gharibeh, Waukesha, WI (US); Garrett R. Gharibeh, Waukesha, WI (US); Justin R. Gharibeh, Waukesha, WI (US)

(73) Assignee: American Fortress Homes, Inc., Waukesha, WI (US)

( * ) Notice: Subject to any disclaimer, the term of this patent is extended or adjusted under 35 U.S.C. 154(b) by 0 days.

(21) Appl. No.: 12/510,417

(22) Filed: Jul. 28, 2009

(65) Prior Publication Data

US 2009/0293280 A1 Dec. 3, 2009

Related U.S. Application Data

(62) Division of application No. 12/127,556, filed on May 27, 2008, now Pat. No. 7,739,844.

(51) Int. Cl.
*E04C 2/08* (2006.01)

(52) U.S. Cl. ..... 52/745.01; 52/783.1; 52/782.1; 52/364

(58) Field of Classification Search ..... 52/309.8, 52/309.9, 309.14, 334, 782.1, 794.1, 454, 52/364, 367, 368, 371
See application file for complete search history.

(56) References Cited

U.S. PATENT DOCUMENTS

| | | | | |
|---|---|---|---|---|
| 1,317,519 | A * | 9/1919 | Madison | 52/454 |
| 1,685,247 | A * | 9/1928 | Selway | 52/356 |
| 2,007,374 | A * | 7/1935 | Kuehne | 52/145 |
| 2,047,109 | A * | 7/1936 | Nagel | 52/405.3 |
| 3,720,029 | A * | 3/1973 | Curran | 52/334 |
| 3,736,716 | A * | 6/1973 | Nishimura | 52/334 |
| 3,802,147 | A * | 4/1974 | O'Konski | 52/630 |
| 3,812,636 | A * | 5/1974 | Albrecht et al. | 52/334 |
| 3,849,957 | A * | 11/1974 | Bastgen | 52/327 |
| 4,164,831 | A * | 8/1979 | Messick et al. | 52/405.3 |
| 4,407,878 | A * | 10/1983 | Smith et al. | 428/119 |
| 4,450,663 | A * | 5/1984 | Watkins | 52/309.4 |
| 4,468,911 | A | 9/1984 | Daga | |
| 4,531,857 | A * | 7/1985 | Bettigole | 404/44 |
| 4,653,246 | A * | 3/1987 | Hepler | 52/787.11 |
| 4,669,240 | A * | 6/1987 | Amormino | 52/236.6 |
| 4,885,884 | A * | 12/1989 | Schilger | 52/354 |

(Continued)

FOREIGN PATENT DOCUMENTS

| | | |
|---|---|---|
| BE | 387 762 A | 5/1932 |

(Continued)

OTHER PUBLICATIONS 5 page excerpt from a Sep. 30, 2009 PCT search report from PCT/US2009/044874, a corresponding PCT application.

(Continued)

*Primary Examiner*—Richard E Chilcot, Jr.
*Assistant Examiner*—Alp Akbasli
(74) *Attorney, Agent, or Firm*—Quarles & Brady LLP

(57) ABSTRACT

A composite building panel includes a substantially rigid planar sheet and a substantially rigid first skin. The first skin includes a plurality of anchors embedded in the sheet. The anchors fix the first skin to the sheet.

13 Claims, 7 Drawing Sheets

U.S. PATENT DOCUMENTS 5,095,674 A * 3/1992 Huettemann ..... 52/405.3
5,107,650 A * 4/1992 Patrick ..... 52/336
5,259,157 A * 11/1993 Ault ..... 52/145
5,473,848 A * 12/1995 Kangas ..... 52/396.02
5,625,986 A * 5/1997 Mansfield et al. ..... 52/255
5,664,378 A * 9/1997 Bettigole et al. ..... 52/414
5,699,644 A * 12/1997 Smith ..... 52/801.1
5,715,637 A 2/1998 Hesterman et al.
5,799,453 A * 9/1998 Westerlund ..... 52/259
5,809,722 A * 9/1998 Bertsche ..... 52/334
5,809,725 A * 9/1998 Cretti ..... 52/426
5,875,604 A 3/1999 Rudd
6,061,986 A * 5/2000 Canada ..... 52/561
6,085,485 A * 7/2000 Murdock ..... 52/783.19
6,282,853 B1 * 9/2001 Blaney et al. ..... 52/223.7
6,357,191 B1 * 3/2002 Ault et al. ..... 52/336
6,363,674 B1 * 4/2002 Carver ..... 52/309.8
6,457,292 B1 10/2002 Vrana
6,511,252 B1 1/2003 Andros
6,584,740 B2 * 7/2003 Record ..... 52/270
6,584,749 B2 * 7/2003 Sperber ..... 52/742.1
6,691,482 B1 * 2/2004 Ault ..... 52/450
6,705,055 B2 * 3/2004 Ritter et al. ..... 52/309.11
6,729,094 B1 * 5/2004 Spencer et al. ..... 52/414
7,073,306 B1 * 7/2006 Hagaman ..... 52/745.09
7,100,336 B2 * 9/2006 Messenger et al. ..... 52/309.17
7,197,854 B2 * 4/2007 Bettigole et al. ..... 52/414
7,278,244 B1 * 10/2007 Rubio ..... 52/600
7,328,667 B1 * 2/2008 Ryan et al. ..... 114/85
7,353,642 B1 * 4/2008 Henriquez ..... 52/741.41
2005/0284098 A1 12/2005 Sumrall

FOREIGN PATENT DOCUMENTS

DE 27 19 361 A1 11/1978
DE 203 18 424 U1 3/2004
DE 20 2005 016546 U1 12/2005
EP 1 801 303 A2 6/2007

OTHER PUBLICATIONS

Office Action for U.S. Appl. No. 12/127,556, dated Nov. 12, 2009.

* cited by examiner

METHOD OF MAKING A COMPOSITE BUILDING PANEL

CROSS REFERENCES TO RELATED APPLICATIONS

This patent application is a divisional application of U.S. patent application Ser. No. 12/127,556 filed May 27, 2008 which issued as U.S. Pat. No. 7,739,844 on Jun. 22, 2010 and claims the benefit there of, the disclosure of which is hereby fully incorporated by reference as if set forth in its entirety herein.

STATEMENT REGARDING FEDERALLY SPONSORED RESEARCH

Not Applicable.

BACKGROUND OF THE INVENTION

This invention relates to building panels, and more particularly, to a composite building panel.

Composite building panels are used in building structures to form walls, floors, and ceilings because they can be designed to have specific structural and insulation characteristics. The panels are formed from a variety of materials including a core sandwiched between inner and outer skins. The skins are often sheets of metal, wood, fiberglass, and the like, fixed to outer surfaces of the core. The core can be formed from an insulating and/or structural material including concrete, foam, and a combination thereof.

The skins are typically fixed to the core by a chemical bond or by using fasteners. Fixing the skins to the core using fasteners, such as nails, edge brackets, and other connectors, is time consuming. Moreover, the fasteners have a tendency to loosen over time causing portions of the skin to separate from the core. Likewise, chemically bonding the skin to the core has the problem of delaminating. Separation of the skin from a concrete core is especially prevalent. Accordingly, a need exists for an improved composite building material.

SUMMARY OF THE INVENTION

The present invention provides a method of forming a composite building panel including forming a plurality of anchors in a substantially rigid first skin and embedding the anchors into at least a portion of a sheet material.

A general objective of the present invention is to provide a method of making a composite building panel which is not prone to delamination. The objective is accomplished by providing a skin having anchors that secure the skin to the sheet.

The foregoing and other objects and advantages of the invention will appear from the following description. In the description, reference is made to the accompanying drawings which form a part hereof, and in which there is shown by way of illustration a preferred embodiment of the invention.

Figure 1:
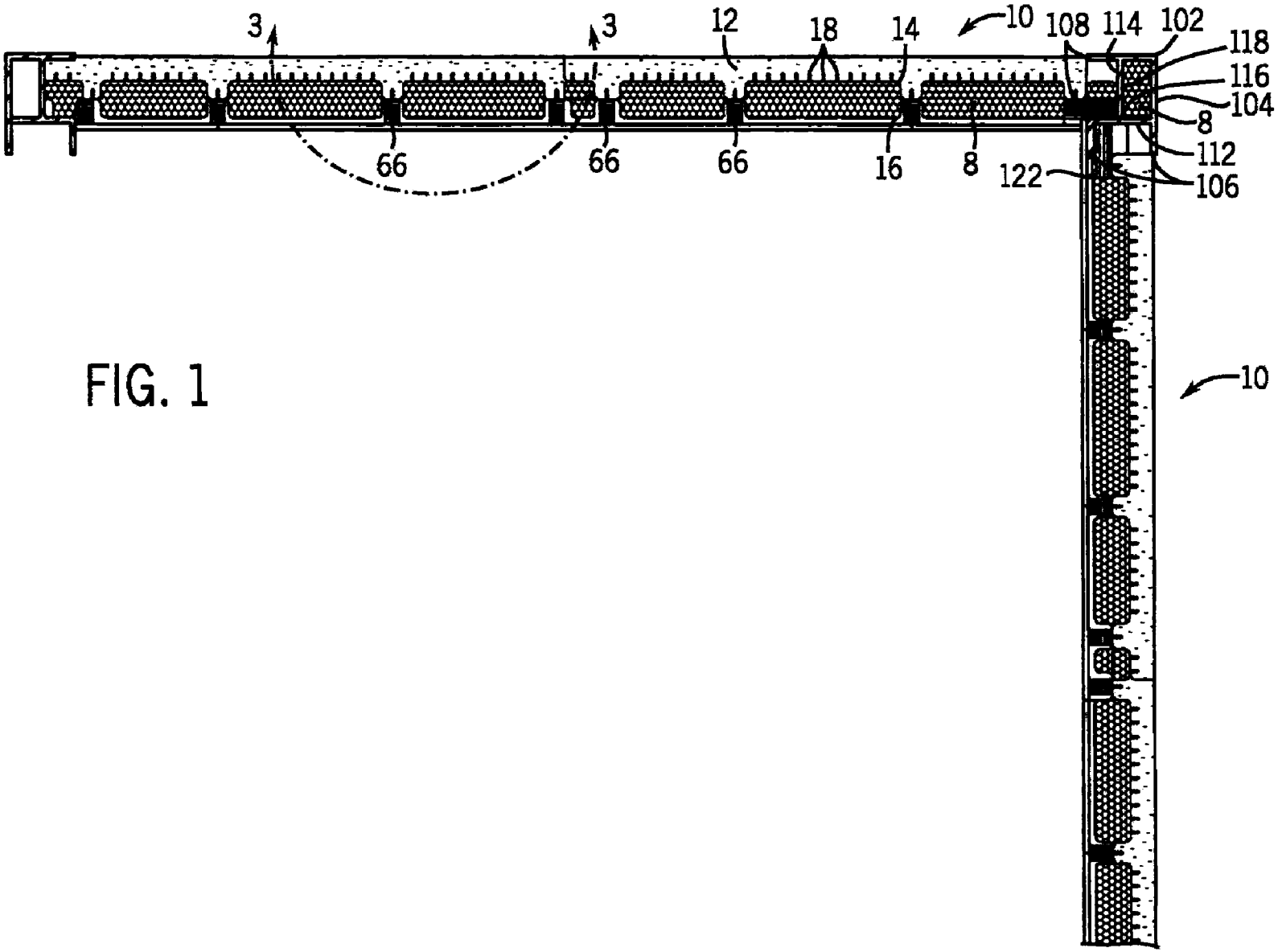
FIG. 1 is a sectional view of a building wall constructed using a composite building panel incorporating the present invention.

Although various forms of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DETAILED DESCRIPTION OF THE PREFERRED EMBODIMENTS

Figure 2:
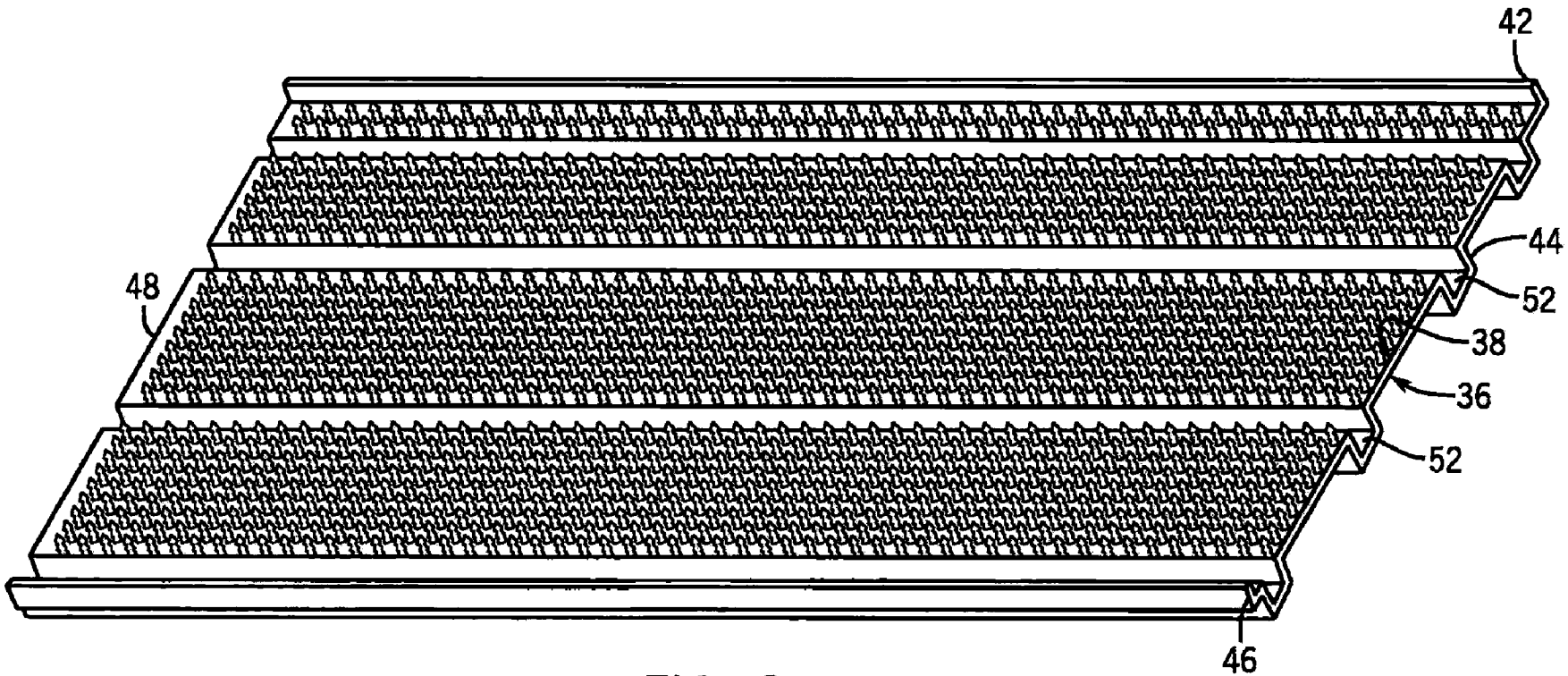
FIG. 2 is a perspective view of the interior skin of the panel of FIG. 1.
Figure 3:
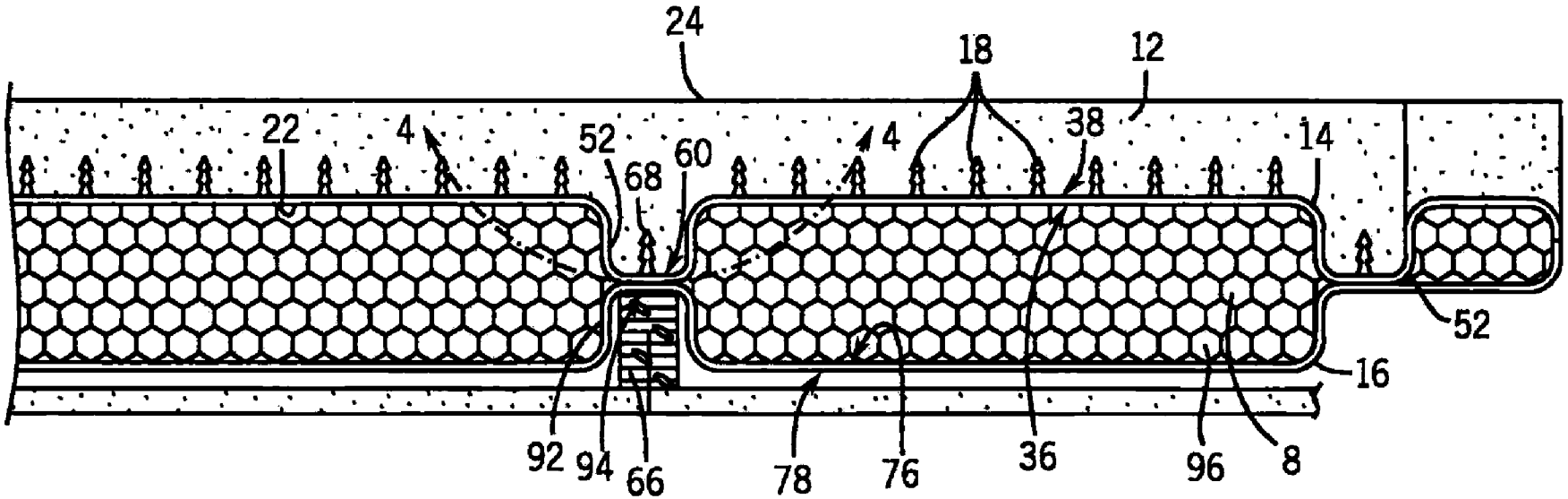
FIG. 3 is a sectional view along line 3-3 of the panel of FIG. 2.

As shown in FIGS. 1-3, a composite building panel 10 incorporating the present invention includes an insulating material 8 sandwiched between an interior skin 14 and an exterior skin 16. The interior skin 14 is fixed to a concrete sheet 12 by a plurality of barbed anchors 18 embedded in the concrete sheet 12. The embedded barbed anchors secure the interior skin 14 to the concrete sheet 12 to prevent the interior skin 14 from separating from the concrete sheet 12.

The concrete sheet 12 is preferably a substantially planar cementitious material, such as concrete, Portland cement, concrete composites, and the like, having an interior planar side 22 and an exterior planar side 24 joined by peripheral edges. The interior planar side 22 is formed to conform with the interior skin 14. Although a cementitious material is preferred, the concrete sheet 12 can be formed from other materials, such as foam, that can securely embed the barbed anchors to prevent the interior skin 14 from separating from the concrete sheet 12.

The interior skin 14 is secured to the concrete sheet 12 by the barbed anchors 18, and has an inner side 36 and an outer side 38 joined by peripheral edges 42, 44, 46, 48. Preferably, the interior skin 14 is a substantially rigid sheet, such as a metal sheet, with the outer side 38 covering at least a portion of the concrete sheet 12. Channels 52 opening toward the concrete sheet 12 formed in the interior skin 14 extend the length of the interior skin 14. An interior skin 14 formed from other materials, such as aluminum, plastic, fiberglass, and the like can be used without departing from the scope of the invention.

The barbed anchors 18 extend outwardly from the interior skin 14 into the concrete sheet 12 and secure the interior skin 14 to the concrete sheet 12. Preferably, the concrete sheet material fills the channels 52 embedding additional barbed anchors 68 extending outwardly from the channel base 60. Although orthogonally extending anchors 68 are shown, the anchors 68 can extend at any angle relative to the interior skin without departing from the scope of the invention.

Figure 4:
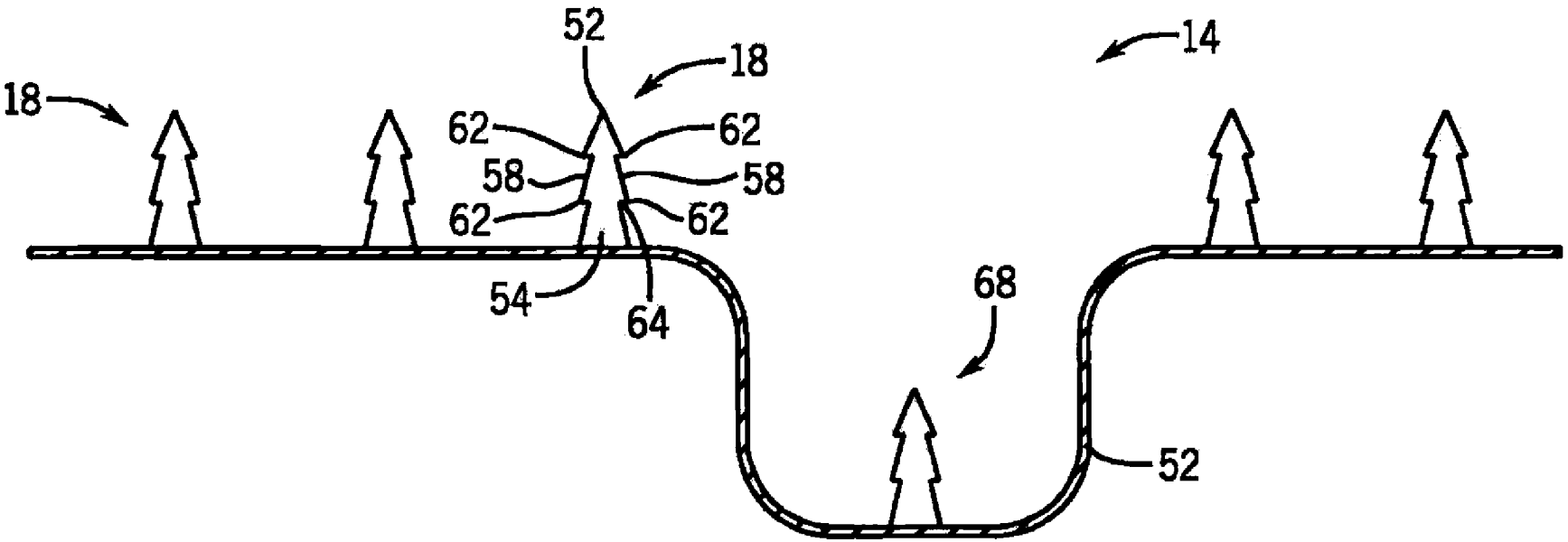
FIG. 4 is a detail view along line 4-4 of FIG. 3.

As shown in FIG. 4, each barbed anchor 18, 68 is preferably formed by punching, such as a by die punch, which forms a substantially flat barbed anchor 18, 68 having a proximal end 54 integral with the interior skin 14 and a distal end 56. The proximal end 54 and distal end 56 are joined by edges 58 having barbs 62 that fix the anchor 18, 68 in the concrete sheet 12. Each barb 62 includes an inwardly facing edge 64 that faces the interior skin 14 and resists separation of the interior skin 14 from the concrete sheet 12. The disclosed embodiment includes two pairs of barbs 62 on each anchor 18. However, any number of barbs 62 can be provides without departing from the scope of the invention.

Referring back to FIGS. 1 and 3, preferably, the exterior skin 16 is formed from a non-corrosive metal sheet, such as steel, aluminum, and the like. However, the exterior skin 16 can be formed other materials, such as wood, plastic, fiberglass, and the like can be used without departing from the scope of the invention. The exterior skin 16 is secured to the interior skin 14, and has an inner side 76 and an outer side 78 joined by peripheral edges. Preferably, the exterior skin 16 is a substantially rigid sheet, such as a metal sheet, with the inner side 76 facing the inner side 36 of the interior skin 14.

Channels 92 opening inwardly, i.e. away from the concrete sheet 12, formed in the exterior skin 16 extend the length of the interior skin 14. Preferably, each exterior skin channel 92 includes a base 94 abutting an interior skin channel base 60 forming elongated spaces 96 between the skins 14, 16 and abutting channels 52, 92. Advantageously, each interior skin channel 92 can receive a furring strip 66 for attaching finished wall material 98, such as drywall, wood paneling, and the like. Alternatively, one or more of the channels 92 can receive conduit, wiring, pipes, and the like. An exterior skin 16 formed from other materials, such as aluminum, plastic, fiberglass, and the like can be used without departing from the scope of the invention.

The elongated spaces 96 formed between the interior skin 14 and exterior skin 16 are preferably filled with the insulating material 8, such as an isocyanate foam, fiberglass, and the like. In one embodiment, the insulating material 8 has adhesive properties that secures the interior skin 14 to the exterior skin 16. Alternatively, the interior skin 14 can be secured to the exterior skin 16 by tack welding the abutting channel bases 60, 94 together, fasteners, tabs, and the like, without departing from the scope of the invention. In addition, the exterior skin 16 can include anchors, such as described above, to fix the exterior skin 16 to the insulating material 8 without departing from the scope of the invention.

In one embodiment, the panel 10 is formed by punching the barbed anchors 18 into the interior skin 14 using a die punch. The interior skin 14 is then aligned over the exterior skin 16 and secured to the exterior skin 16, such as by curing the insulating material in the elongated spaces 96 between the interior skin 14 and exterior skin 16. The punched interior skin 14 is then laid horizontally with the anchors 18 extending upwardly in an upwardly extending form proximal the edges 42, 44, 46, 48 of the interior skin 14. The concrete sheet 12 in a fluid form is poured onto the interior skin 14 inside the form. The concrete sheet 12 is then cured to embed to anchors 18 in the concrete sheet 12 and secure the interior skin 14 to the concrete sheet 12.

Advantageously, as shown in FIG. 1, the resulting composite panel 10 can be formed to the desired dimensions during manufacturing or cut to the desired dimensions in the field. Adjacent composite panels 10 can be joined at a corner with a corner column 102. The corner column 102 includes an elongated hollow column 104 having two pairs of outwardly extending legs 106, 108. Each pair of legs 106, 108 extends outwardly from one of two adjacent walls 112, 114 forming part of the column 104 and receives an edge 116, 118 of one of the adjacent panels 10 therebetween. A block 122 or shim wedged between the composite panel 10 and one of the legs 106, 108 fills any gap between the leg 106, 108 and composite panel 10, if desired. Advantageously, the elongated hollow column 104 can be filled with the insulating material 8 to minimize heat loss from the resulting building.

Figure 5:
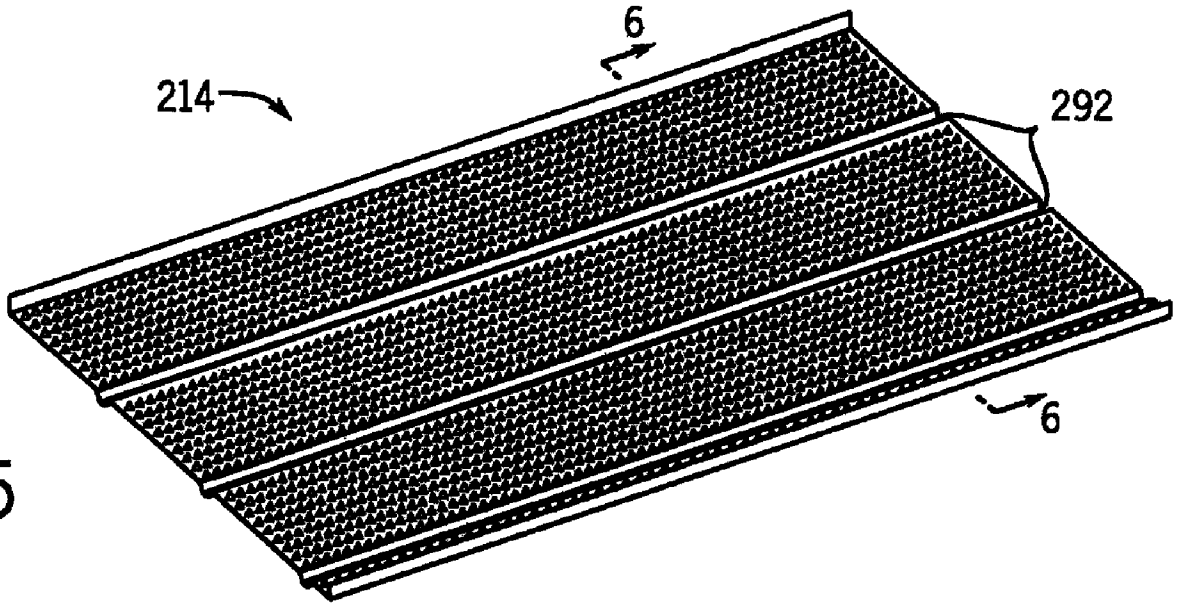
FIG. 5 is a perspective view of an alternate interior skin.
Figure 6:
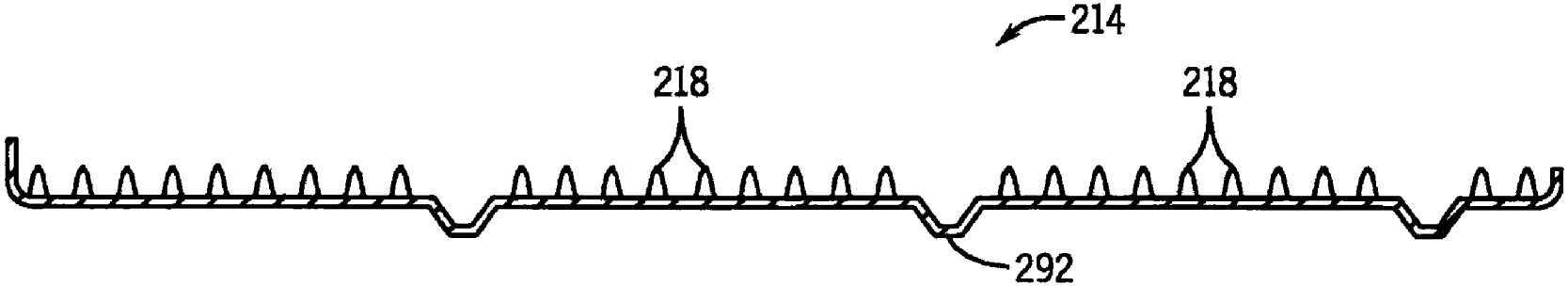
FIG. 6 is a sectional view along line 6-6 of the panel of FIG. 5.

An alternate interior skin 214, such as shown in FIGS. 5 and 6, include outwardly extending anchors 218 without barbs. As in interior skin 14 described above, the anchors 218 are formed in rows extending the length of the interior skin 214 and are preferably formed by punching. In the embodiment shown in FIGS. 5 and 6, the anchors are not formed in a channel 292.

Figure 7:
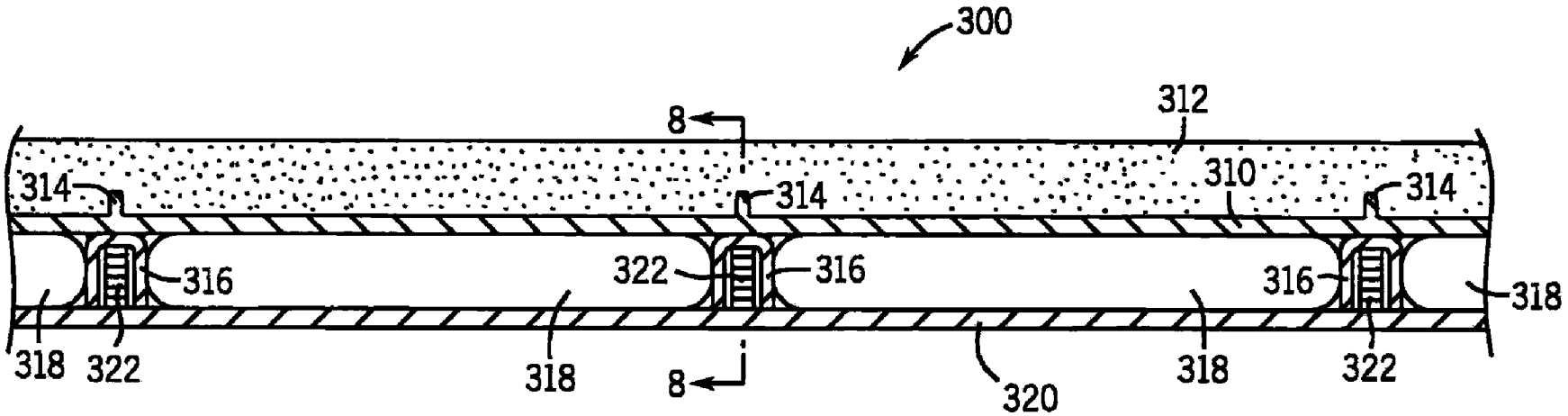
FIG. 7 is a sectional view of another form of a composite building panel.
Figure 8:
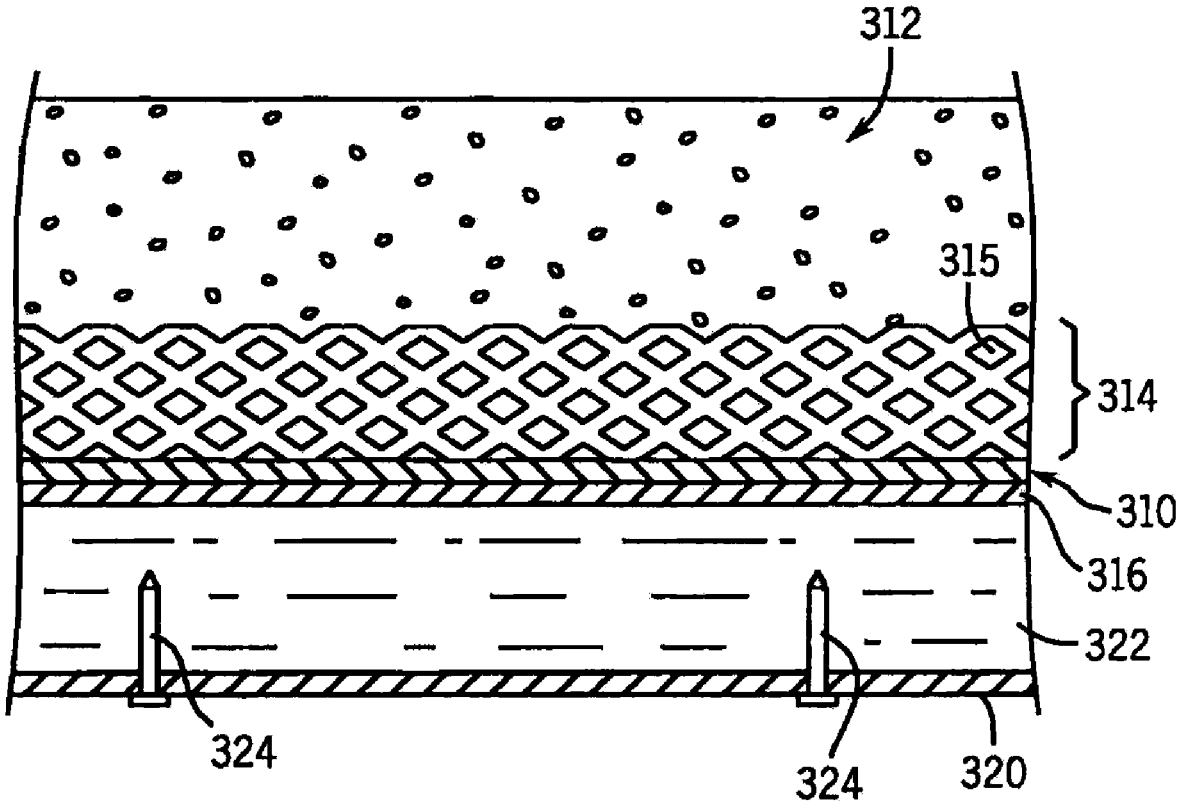
FIG. 8 is a sectional view of the composite building panel of FIG. 7 along line 7-7.

Referring now to FIGS. 7 and 8, and according to yet another aspect of the invention, another composite building panel 300 is shown. In this composite building panel 300, one side of a skin 310 is joined to a surface of a sheet 312. This side of the skin 310 includes a plurality of anchors 314 which protrude into the sheet 312 to secure the skin 310 into the sheet 312. As can be seen most clearly in FIG. 8, the plurality of anchors 314 can be an expanded metal mesh orthogonally welded to the skin 310. However, the plurality of anchors 314 may also be barbed anchors as described above, or other suitable structures for anchoring the skin 310 to the sheet 312.

According to one form of the invention, the skin 310 is formed from sheet steel. However, the skin 310 could also be formed from other materials such as aluminum, plastic, fiberglass, and the like without departing from the scope of the invention. The sheet 312 can be formed of a planar cementitious material such as, for example, concrete, Portland cement, concrete composites, and the like. Likewise, the sheet 312 could also be formed from other materials, such as foam and the like, that can securely embed the plurality of anchors 314 in the sheet 312 to prevent the skin 310 from separating from the sheet 312.

In the case where the plurality of anchors 314 is an expanded metal mesh, the plurality of anchors 314 may be embedded in the sheet 312 before the sheet 312 is cast or otherwise formed. In this way, the material of the sheet 312 forms in and through the holes 315 of the mesh to securely lock the expanded metal mesh and attached skin 310 to the sheet 312. It is contemplated that the mesh may extend into the sheet 312 approximately 1 inch, although more or less of the mesh may extend into the sheet 312 depending on the mesh size and the material of the sheet 312.

On the other side of the skin 310, a plurality of brackets 316, such as U-channels, are joined to the skin 310. In one form, both the skin 310 and the plurality of brackets 316 are composed of steel and are welded together. However, other materials and other forms of joining the plurality of brackets 316 to the skin 310 are contemplated.

When the plurality of brackets 316 are joined to the skin 310, spaces are formed between the plurality of brackets 316. An insulating material 318 can be placed in one or more of these spaces. The insulating material 318 may be any one of a number of materials such as, for example, an isocyanate foam, fiberglass, and the like. However, it is also contemplated that no insulating material 318 need be present or that the air between the plurality of brackets 316 may serve as insulation.

A board 320 can be connected to the plurality of brackets 316. The board 320 may be any one of a number of materials such as, for example, plywood, drywall, and the like. When the board 320 is attached to the plurality of brackets 316, the board 320 and the skin 310 sandwich the plurality of brackets 316 and any insulating material 318 therebetween. One or more boards 320 may be placed next to one another to create the appearance of a continuous panel.

The board 320 may be attached to the plurality of brackets 316 directly or indirectly. For example, in one form of the attachment, a furring strip 322 or other intermediary connective component is inserted into the U-channel and secured therein by the use of an adhesive such as glue, epoxy, and the like or by fasteners such as nails, screws, staples, bolts and the like. Once the furring strip 322 is secured in the U-channel, then the board 320 may be secured to the furring strip 322 using fasteners 324 such as nails, screws, staples, bolts, and the like. However, it is also contemplated that the board 320 may be directly attached to the plurality of brackets 316 by the use of adhesives, nails, screws, bolts, staples, fasteners, and the like.

It is contemplated that various types of cables, conduit, and the like may be run through the composite building panel 300. For example, in the case where the plurality of brackets 316 are U-channels, the U-channels may be well-suited for housing cables or conduits.

While there has been shown and described what are at present considered the preferred embodiments of the invention, it will be obvious to those skilled in the art that various changes and modifications can be made therein without departing from the scope of the invention defined by the appended claims. Therefore, various alternatives and embodiments are contemplated as being within the scope of the following claims particularly pointing out and distinctly claiming the subject matter regarded as the invention.

What is claimed is:

1. A method of making a composite panel, said method comprising:

forming a plurality of anchors in a substantially rigid first skin;

embedding said anchors into at least a portion of a sheet material;

attaching a plurality of brackets to the first skin; and affixing at least one furring strip to each of the plurality of brackets.

2. The method as in claim 1, in which said anchors are formed by punching said anchors into said first skin to form said anchors as an integral part of said first skin.

3. The method as in claim 1, in which said anchors are formed by joining a mesh to the first skin.

4. The method as in claim 1, including forming at least one channel in said first skin, and filling said at least one channel with said sheet material.

5. The method as in claim 1, including forming said sheet with a cementitious material.

6. The method as in claim 1, in which said first skin is a metal sheet.

7. The method as in claim 1, including attaching a second skin to said furring strips to form at least one space between the first skin and the second skin.

8. The method as in claim 1, wherein the plurality of brackets and the first skin are metal and attaching the plurality of brackets to the first skin includes welding the plurality of brackets to the first skin.

9. The method as in claim 7, including filling said at least one space with an insulating material.

10. The method as in claim 1, in which said sheet is initially a fluid material, and said anchors are embedded upon curing said fluid material to form said sheet.

11. The method as in claim 1, in which said anchors are formed with barbs.

12. The method as in claim 1, wherein affixing at least one furring strip to each of the plurality of brackets includes inserting the at least one furring strip into a channel formed in each of the plurality of brackets.

13. The method as in claim 1, wherein the furring strip comprises wood.

* * * * *